US007363847B2

(12) United States Patent
Reed

(10) Patent No.: US 7,363,847 B2
(45) Date of Patent: Apr. 29, 2008

(54) VENTING SYSTEM AND INITIATOR THEREOF

(75) Inventor: Roger B. Reed, Azle, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 249 days.

(21) Appl. No.: 11/085,720

(22) Filed: Mar. 21, 2005

(65) Prior Publication Data

US 2006/0207460 A1 Sep. 21, 2006

(51) Int. Cl.
*F41H 5/007* (2006.01)

(52) U.S. Cl. ..... 89/36.17

(58) Field of Classification Search ..... 89/36.17
See application file for complete search history.

(56) References Cited

U.S. PATENT DOCUMENTS 3,297,503 A * 1/1967 Hoffmann et al. ..... 149/39
5,402,728 A * 4/1995 Garner ..... 102/326
5,466,537 A * 11/1995 Diede et al. ..... 428/548
5,538,795 A 7/1996 Barbee, Jr. et al. ..... 428/420
5,824,941 A * 10/1998 Knapper ..... 89/36.17
6,619,181 B1 * 9/2003 Frey et al. ..... 89/36.17
2002/0182436 A1 12/2002 Weihs et al. ..... 428/635
2004/0247930 A1 12/2004 Weihs et al. ..... 428/635

OTHER PUBLICATIONS

Dictionary.com definition for the term "manifold" (7 pages) as obtained on Sep. 13, 2007.*

* cited by examiner

*Primary Examiner*—Stephen M Johnson
(74) *Attorney, Agent, or Firm*—Daren C. Davis; James E. Walton

(57) ABSTRACT

An initiator includes a reactive panel having a substrate and a plurality of reactive layers disposed on the substrate. The initiator further includes a transition manifold coupled with the reactive panel. A system for venting a container includes a venting device and an initiator coupled with the venting device. The initiator includes a reactive panel having a substrate, a plurality of reactive layers disposed on the substrate, and a transition manifold coupled with the reactive panel. A method of initiating a venting system includes providing a venting system operatively associated with the container, reacting a first material of the venting system with a second material of the venting system to produce an exothermic reaction, and venting the container as a result of reacting the first material with the second material.

14 Claims, 7 Drawing Sheets

VENTING SYSTEM AND INITIATOR THEREOF

BACKGROUND

1. Field of the Invention

The present invention relates to a venting system and an initiator for the venting system. In particular, the present invention relates to a system for venting containers housing energetic materials and an initiator for the system.

2. Description of Related Art

Energetic materials, such as explosives and propellants, are often found in confined spaces, for example, within munitions. Under normal conditions, these materials are unlikely to explode or burn spontaneously; however, many are sensitive to heat and mechanical shock. For example, when exposed to extreme heat (as from a fire) or when impacted by bullets or fragments from other munitions, the energetic materials may be initiated, causing the munitions, in which the energetic materials are disposed, to inadvertently explode prematurely. Conventionally, armor is used to protect munitions and other energetic material-containing devices from being impacted by bullets, fragments, or other such projectiles. Armor is, however, heavy by nature and may not be suitable for some implementations, such as in mobile containers for munitions.

Efforts have been made to develop "insensitive munitions," which are munitions that are generally incapable of detonation except in its intended mission to destroy a target. In other words, if fragments from an explosion strike an insensitive munition, if a bullet impacts the munition, or if the munition is in close proximity to a target that is hit, it is less likely that the munition will detonate. Similarly, if the munition is exposed to extreme temperatures, as from a fire, the munition will likely only burn, rather than explode.

One way that munitions have been made more insensitive is by developing new explosives and propellants that are less likely to be initiated by heating and/or inadvertent impact. Such materials, however, are typically less energetic and, thus, may be less capable of performing their intended task. For example, a less energetic explosive may be less capable of destroying a desired target than a more energetic explosive. As another example, a less energetic propellant may produce less thrust than a more energetic propellant, thus reducing the speed and/or the range of the munition. Additionally, the cost to verify and/or qualify new explosives and/or propellants, from inception through arena and system-level testing, can be substantial when compared to improving the insensitive munition compliance of existing explosives and/or propellants.

Another system has been developed that selectively vents a container in which an energetic material is disposed, such as a munition, at a predetermined temperature or within a predetermined range of temperatures. In one particular embodiment, a pyrotechnic train is initiated at a particular temperature or within a particular range of temperatures that, in turn, detonates a cutting charge, such as a linear shaped charge. The explosive products from the cutting charge are used to cut the container, thus releasing pressure therein or preventing the buildup of pressure therein. The impact of a bullet, fragment, or shaped charge jet with the container proximate the venting system may result in a temperature sufficient to initiate the venting system. Additional safeguards, however, may be desirable to ensure such a venting system is initiated in the event of an impact to the container.

While there are many ways known in the art to render munitions more insensitive, considerable room for improvement remains. The present invention is directed to overcoming, or at least reducing, the effects of one or more of the problems set forth above.

SUMMARY OF THE INVENTION

In one aspect of the present invention, an initiator is provided. The initiator includes a reactive panel having a substrate and a plurality of reactive layers disposed on the substrate. The initiator further includes a transition manifold coupled with the reactive panel.

In another aspect of the present invention, a system for venting a container is provided. The system includes a venting device and an initiator coupled with the venting device. The initiator includes a reactive panel having a substrate, a plurality of reactive layers disposed on the substrate, and a transition manifold coupled with the reactive panel.

In yet another aspect of the present invention, a method of initiating a venting system is provided. The method includes providing a venting system operatively associated with the container, reacting a first material of the venting system with a second material of the venting system to produce an exothermic reaction, and venting the container as a result of reacting the first material with the second material.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
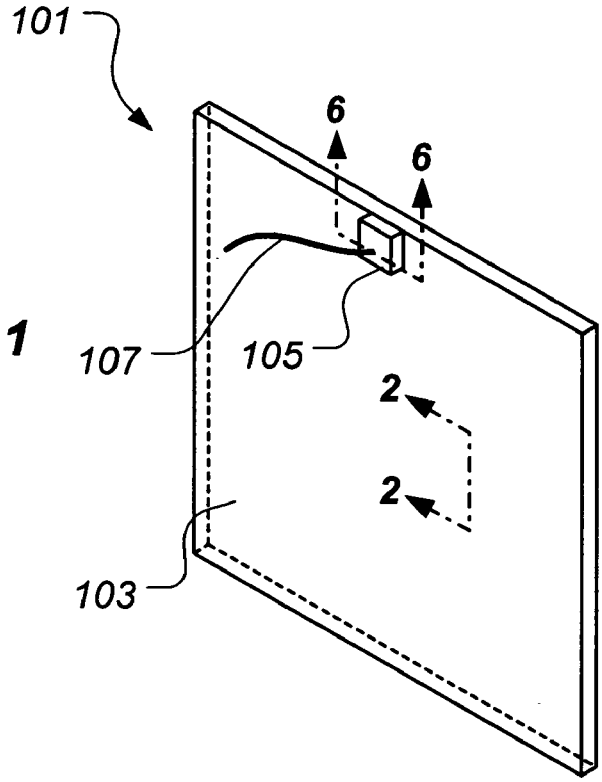
FIG. 1 is a stylized, perspective view of an illustrative embodiment of an initiator according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a venting system for selectively venting a container and an initiator for the venting system. The venting system requires no external power to vent the container or to initiate the venting system.

Figure 2:
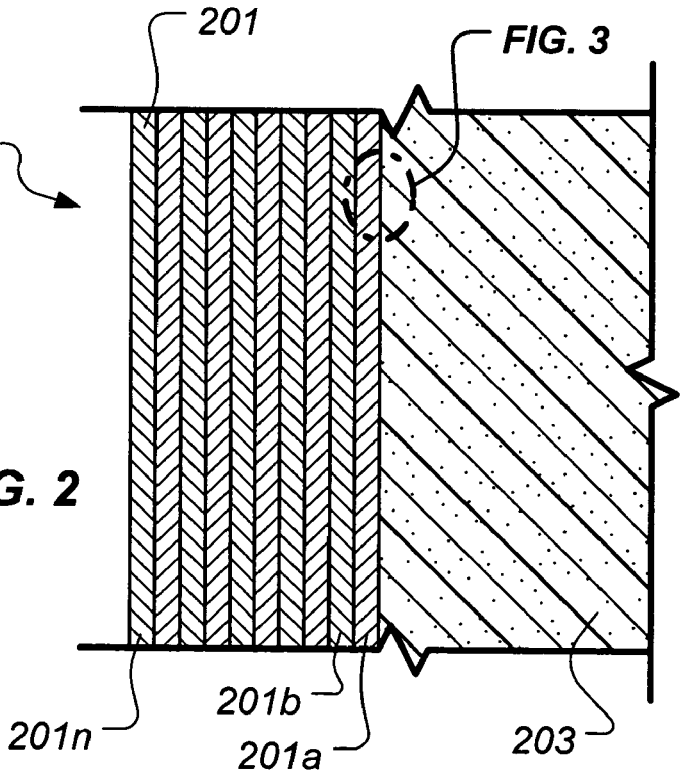
FIG. 2 is a stylized, cross-sectional view of the initiator of FIG. 1 taken along the line 2-2 of FIG. 1.

FIGS. 1 and 2 depict an illustrative embodiment of an initiator 101 according to the present invention. FIG. 1 provides a perspective view of initiator 101 and FIG. 2 illustrates a cross-sectional view of a portion of initiator 101 taken along the line 2-2 in FIG. 1. In the illustrated embodiment, initiator 101 includes a reactive panel 103 and one or more transition manifolds 105 that are adapted for coupling with one or more transfer lines 107. Particular illustrative characteristics of each of these elements are discussed in greater detail below.

Referring particularly to FIG. 2, reactive panel 103 comprises a plurality of reactive layers 201 (only one labeled for clarity) disposed on a substrate 203. A first reactive layer 201*a* is disposed directly onto substrate 203 and a second reactive layer 201*b* is disposed on first reactive layer 201*a*. Reactive layer 201*n* is the nth reactive layer, corresponding to the total number of reactive layers comprising plurality of reactive layers 201. The number of reactive layers comprising plurality of reactive layers 201 will differ depending upon the particular implementation of initiator 101. In two particular embodiments, plurality of reactive layers 201 comprises 10 reactive layers and 20 reactive layers, respectively. That is, in these particular embodiments, reactive layer 201*n* corresponds to the tenth reactive layer in one embodiment and corresponds to the twentieth reactive layer in another embodiment. The scope of the present invention, however, is not so limited but, rather, encompasses any suitable number of reactive layers (e.g., reactive layers 201*a*, 201*b*, etc.) depending upon the implementation of initiator 101.

Note that the material comprising substrate 203 is not pertinent to the present invention and may, thus, comprise any material suitable for substrate 203. For example, substrate 203 may comprise a metal, such as aluminum, an aluminum alloy, a steel, or the like; or may comprise a composite material, such as carbon/epoxy composite, fiberglass/epoxy composite, or the like.

Figure 3:
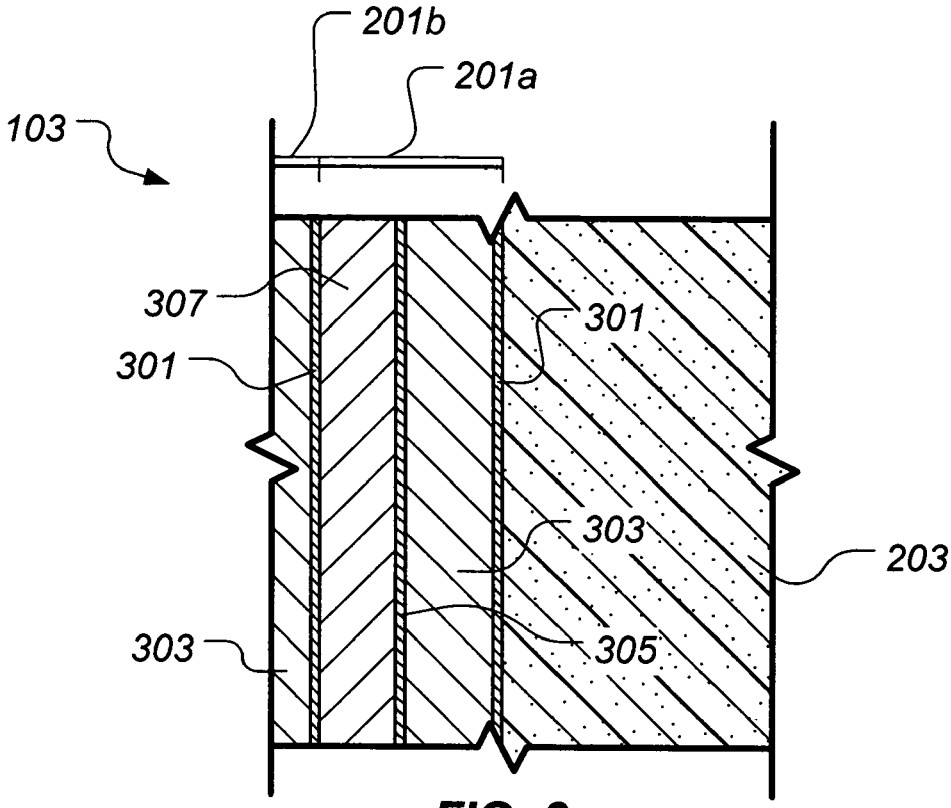
FIG. 3 is a stylized, enlarged view of a first illustrative embodiment of a portion, indicated in FIG. 2, of the initiator of FIGS. 1 and 2.
Figure 4:
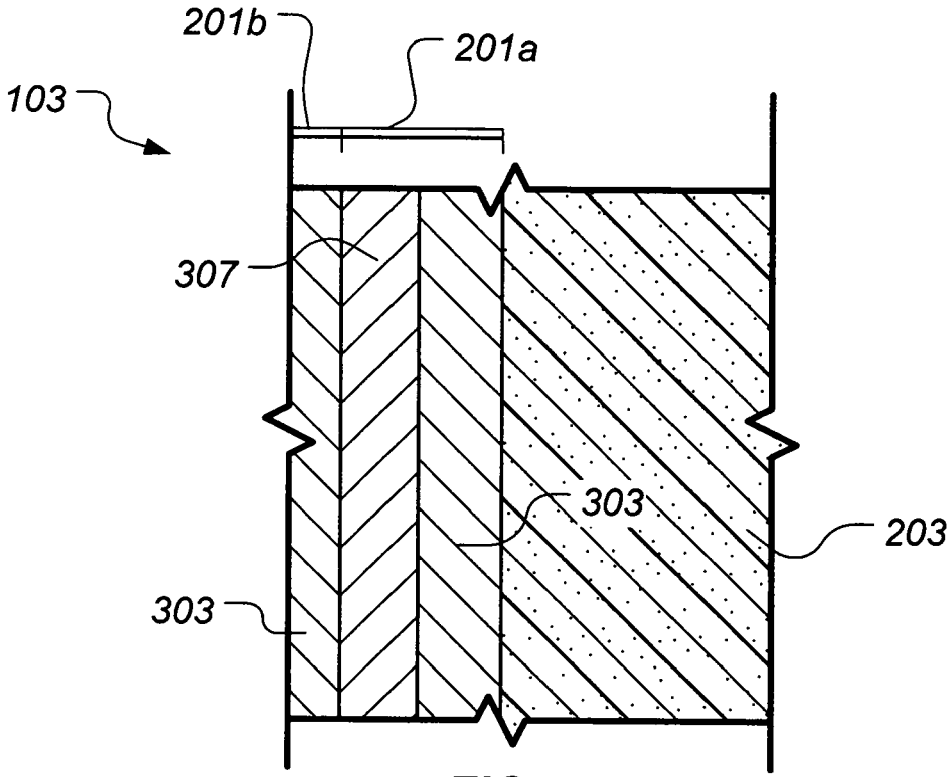
FIG. 4 is a stylized, enlarged view of a second illustrative embodiment of the portion, indicated in FIG. 2, of the initiator of FIGS. 1 and 2.
Figure 5:
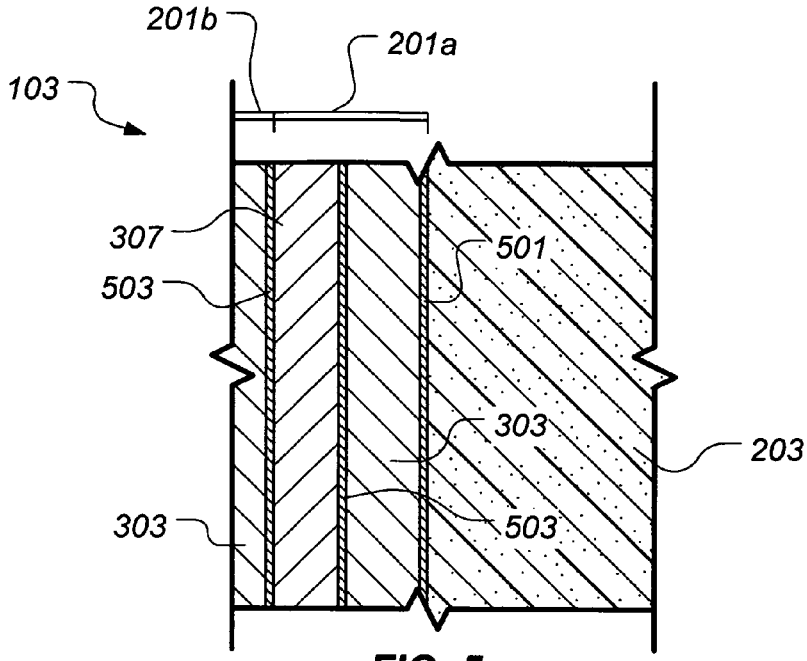
FIG. 5 is a stylized, enlarged view of a third illustrative embodiment of the portion, indicated in FIG. 2, of the initiator of FIGS. 1 and 2.

FIGS. 3-5 depict enlarged views of a portion of the reactive panel 103, as indicated in FIG. 2, particularly illustrating various embodiments of one of reactive layers 201. While, FIGS. 3-5 depict particular illustrative embodiments of reactive layer 201*a*, any of reactive layers 201*a*, 201*b*, . . . , 201*n* may include such a construction.

Referring now to FIG. 3, a first illustrative embodiment of reactive layer 201*a* is provided. Reactive layer 201*a* includes a first separation layer 301 disposed between substrate 203 and a first sublayer 303. Reactive layer 201*a* further includes a second separation layer 305 disposed between first sublayer 303 and a second sublayer 307. Note that, in this particular embodiment, another first separation layer 301 is disposed between second sublayer 307 of reactive layer 201*a* and first sublayer 303 of reactive layer 201*b*.

First sublayer 303 comprises a material A that, in response to a stimulus sufficient to breach second separation layer 305, will react with a material B of second sublayer 307. First and second separation layers 301, 305 are provided merely to inhibit first and second sublayers 303, 307 from reacting during fabrication and/or to improve adhesion of first and second sublayers 303, 307 to adjacent elements, as is more fully discussed below. Generally, the material pairs (i.e., materials A and B) are materials that react with large negative heats of formation and high adiabatic reaction temperatures to form stable compounds.

Examples of materials A and B include, but are not limited to, materials that form silicides, aluminides, borides, or carbides. For example, material pairs (i.e., materials A and B) that form silicides may include rhodium/silicon, nickel/silicon, and zirconium/silicon. Material pairs that form aluminides may include, but are not limited to, nickel/aluminum, titanium/aluminum, Monel®/aluminum, and zirconium/aluminum. Note that Monel® is a nickel/copper alloy produced by Special Metals Corporation of Huntington, W. Va. Material pairs that form borides and carbides include, but are not limited to, titanium/boron and titanium/carbon, respectively.

Materials A and B may also include thermite reacting compounds, such as aluminum/iron oxide and aluminum/copper oxide. Materials A and B may also comprise alloys, such as alloys of the elements provided above, metallic glasses, and composite materials, such as metal ceramics.

While many different processes may be used to construct first and second sublayers 303, 307 and first and second separation layers 301, 305, some examples of such processes include vacuum evaporation, physical vapor deposition (or "sputtering"), and chemical vapor deposition. For example, to apply first separation layer 301 to substrate 203 using vacuum evaporation, substrate 203 and a source comprising the material of first separation layer 301 are placed in a vacuum chamber. The source material is evaporated and collects on substrate 203. Physical vapor deposition is also conducted in a vacuum. Positively charged ions of an inert gas, e.g., argon, are attracted to a target comprising the material of first separation material layer 301. When the ionized gas atoms strike the target, target material atoms or molecules are "sputtered" and deposited on substrate 203. In chemical vapor deposition, which also occurs in a vacuum, a gas containing the material of first separation layer 301 is chemically reduced to produce the material of first separation layer 301, which is deposited on substrate 203.

As discussed above, first and second sublayers 303, 307 react with one another when subjected to a stimulus sufficient to impact or breach at least one of first and second separation layers 301, 305. Accordingly, first and second separation layers 301, 305 are thin as compared to the thicknesses of first and second sublayers 303, 307. First and second separation layers 301, 305 may have thicknesses ranging from only a single atom or molecule thick to, for example, tens of angstroms thick.

FIGS. 4 and 5 depict a second illustrative embodiment of reactive layer 201*a* according to the present invention. It may be acceptable, in some implementations, to omit separation layers 301, 305, producing the structure shown in FIG. 4. However, as shown in FIG. 5 for example, omitting first separation layer 301 may allow a small portion of material of first sublayer 303 to intermingle with material of substrate 203 during fabrication, producing a first intermingled zone 501. Thus, first intermingled zone 501, if present, includes atoms or molecules of first sublayer 303 and of substrate 203. Omitting second separation layer 305, similarly, may allow a small portion of material of second sublayer 307 to intermingle with material of first sublayer 303 during fabrication, producing a second intermingled zone 503. Second intermingled zone 503, if present, includes atoms or molecules of second sublayer 307 and of first sublayer 303. Since the materials comprising first and second sublayers 303, 307 react when combined, second intermingled zone 503, if present, comprises the reacted product of the materials comprising first and second sublayers 303, 307. Note that other aspects of the embodiment illustrated in FIGS. 4 and 5 correspond generally to those of the embodiment illustrated in FIG. 3.

Figure 6:
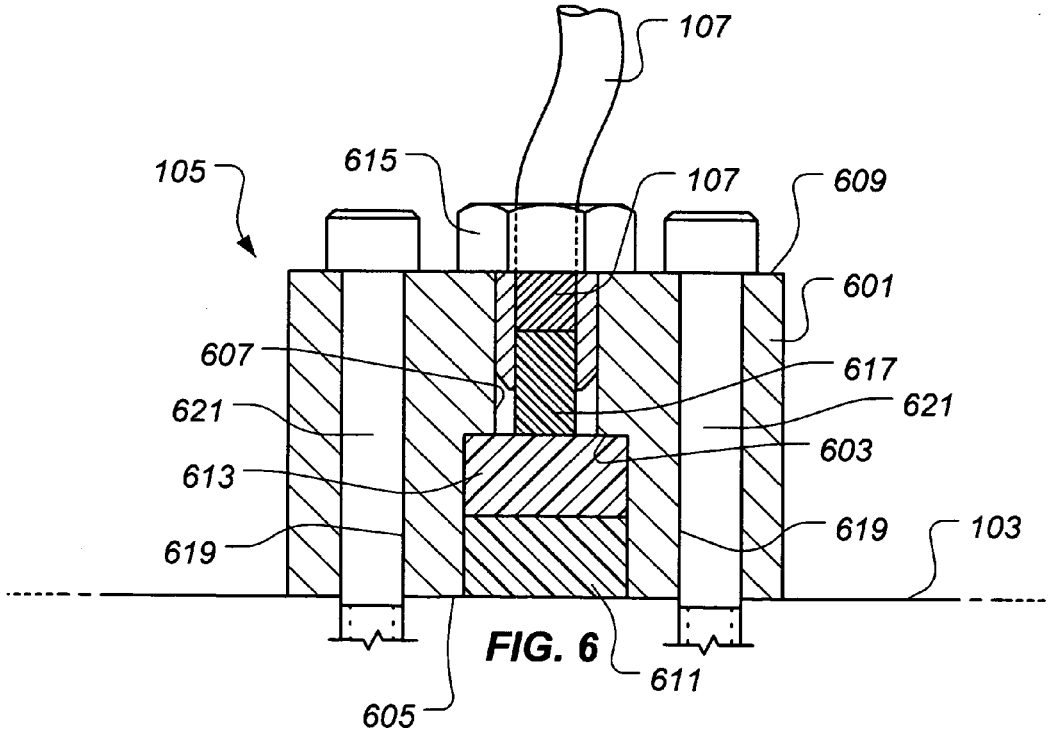
FIG. 6 is a stylized, cross-sectional view of one particular embodiment of a transition manifold of FIG. 1, taken along the line 6-6 of FIG. 1.

FIG. 6 depicts one particular illustrative embodiment of transition manifold 105 of FIG. 1. Note that FIG. 6 provides a cross-sectional view of transition manifold taken along the line 6-6 in FIG. 1. In the illustrated embodiment, transition manifold 105 comprises a housing 601 defining a cavity 603 extending from a lower surface 605 of housing 601 and a passage 607 leading from cavity 603 through an upper surface 609 of housing 601. A first booster 611 is disposed in cavity 603 adjacent or in contact with reactive panel 103. A second booster 613 is disposed in cavity 603 adjacent or in contact with first booster 611. Transition manifold 105 further comprises a fitting 615 engaged with housing 601 adapted to retain transfer line 107 in place. While fitting 615 may be retained in housing 601 by a variety of means, fitting 615 is threadedly engaged with housing 601 in one particular embodiment.

Still referring to FIG. 6, transition manifold 105 further comprises a third booster 617 disposed adjacent or in contact with second booster 613. Third booster 617 is disposed in fitting 615 such that transfer line 107 may be placed adjacent or in contact with third booster 617. Note that transfer line 107 may comprise shielded mild detonating cord or the like. Boosters 611, 613, 617 may comprise materials such as CH-6 explosive or other high explosives. Generally, first booster 611 comprises a material that is more energetic than the material of reactive panel 103. Second booster 613 comprises a material that is more energetic than the material of first booster 611. Third booster 617 comprises a material that is more energetic than the material of second booster 613. In embodiments wherein boosters 611, 613 comprise the same material, the material of second booster 613 may be more firmly packed than that of first booster 611 and, thus, have a higher density, than that of first booster 611. Similarly, wherein boosters 613, 617 comprise the same material, the material of third booster 617 may be more firmly packed than that of booster 613.

Housing 601 further defines attachment passages 619 adapted to receive fasteners 621 for attaching transition manifold 105 to reactive panel 103. Note that the particular construction of transition manifold 105 shown in FIG. 6 is merely one of many different constructions encompassed by the present invention. For example, transition manifold 105 may be coupled with or attached to reactive panel 103 by another means, such that housing 601 omits attachment passages 619. Moreover, transition manifold 105 may comprise one or more boosters (e.g., boosters 611, 613, 617) or, in some embodiments, transition manifold 105 may be adapted to retain transfer line 107 adjacent or in contact with reactive panel 103. In some alternative embodiments, transition manifold 105 may be adapted to directly couple transfer line 107 to reactive panel 103, omitting housing 601.

Figure 7A:
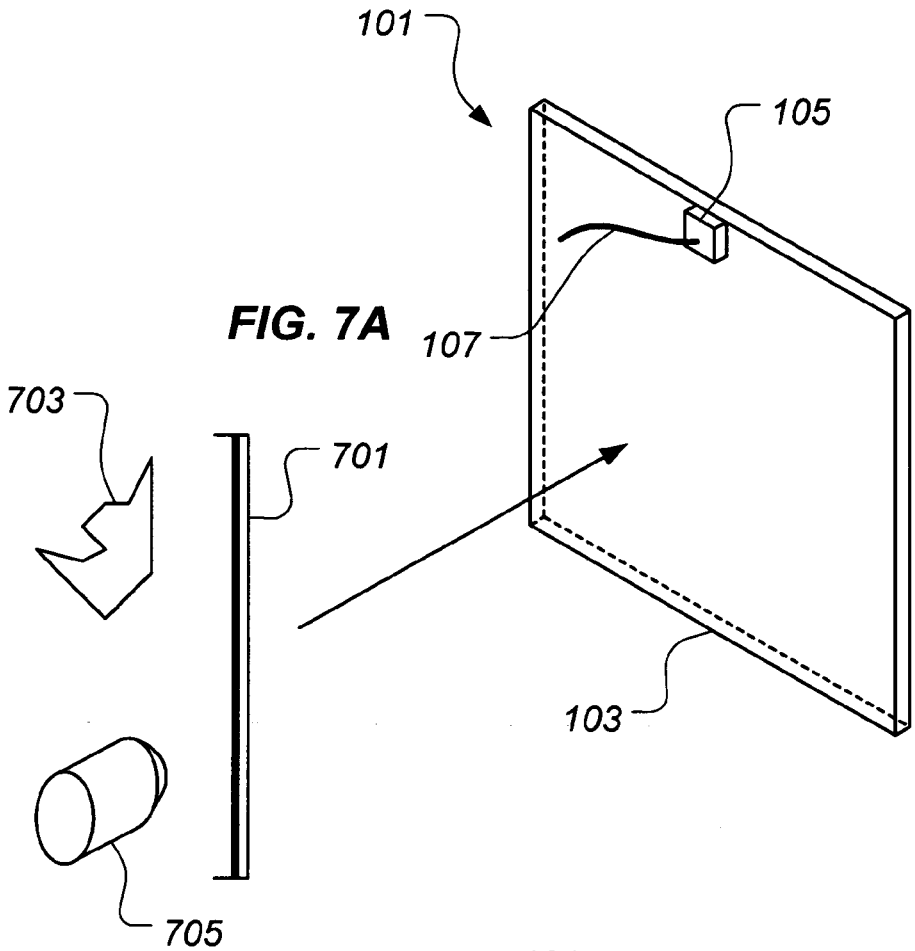
FIGS. 7A and 7B are stylized, perspective views of the initiator of FIG. 1 in one particular use.
Figure 7B:
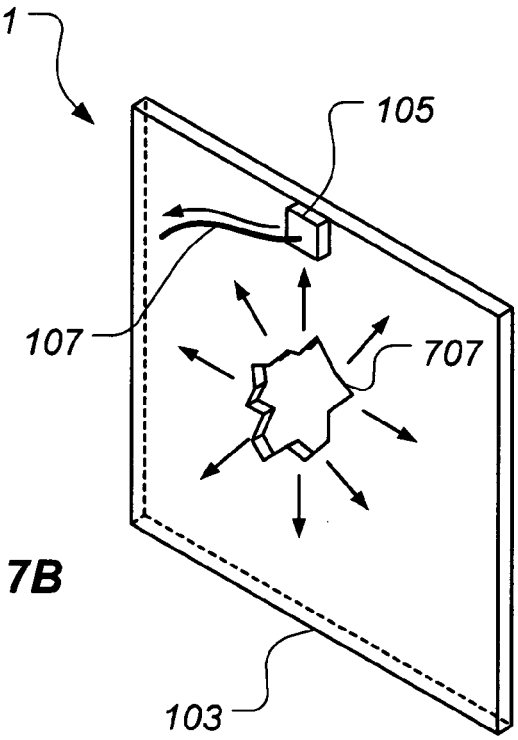

FIGS. 7A-7B illustrate initiator 101 in one particular use. FIG. 7A illustrates a projectile 701, such as a fragment 703 or a munition round 705, being propelled toward reactive panel 103. When reactive panel 103 is impacted, for example as shown in FIG. 7B, materials of first and second sublayers 303, 307 (shown in FIGS. 3-5) exothermically react. Note that penetration of reactive panel 103 is not required for sublayers 303, 307 to react. The self-perpetuating reaction progresses radially away from an impact site 707. A portion of the reaction reaches transition manifold 105, wherein, in one embodiment, the reaction is transitioned from reactive panel 103, through boosters 611, 613, 617 (see FIG. 6), to transfer line 107. The initiated transfer line 107 then transmits the initiation to other systems coupled with initiator 101, as will be more fully discussed below.

Figure 8:
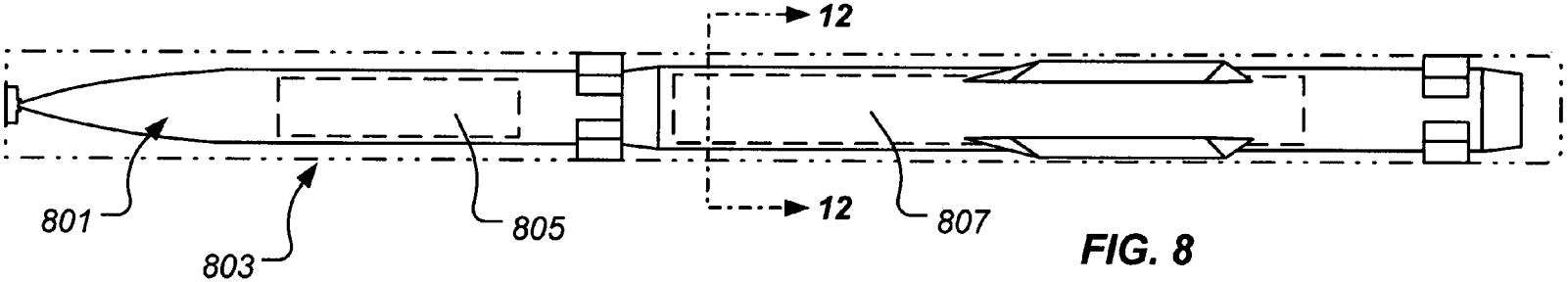
FIG. 8 is a stylized, side view of an exemplary munition disposed in an exemplary canister, which is shown in phantom, all according to the present invention.

FIG. 8 provides a stylized elevational view of a munition 801 disposed within a canister 803 (shown in phantom). Such canisters may be used, for example, to protect munition 801 during shipment or to house munition 801 prior to launch. The type of canister 803, however, is immaterial to the practice of the present invention. Disposed within munition 801 are energetic materials, specifically an explosive 805 and a propellant 807. The shapes, forms, and locations of energetic materials 805, 807 illustrated in FIG. 8 are merely exemplary. Energetic materials 805, 807 may take on any number of shapes or forms and be disposed at various locations within munition 801, depending upon the design of munition 801.

As described in more detail below, the initiator of the present invention, e.g., initiator 101, selectively vents munition 801 proximate explosive 805 and/or propellant 807. The venting relieves pressure within munition 801 to inhibit inadvertent detonation of explosive 805 and/or propellant 807.

Figure 9:
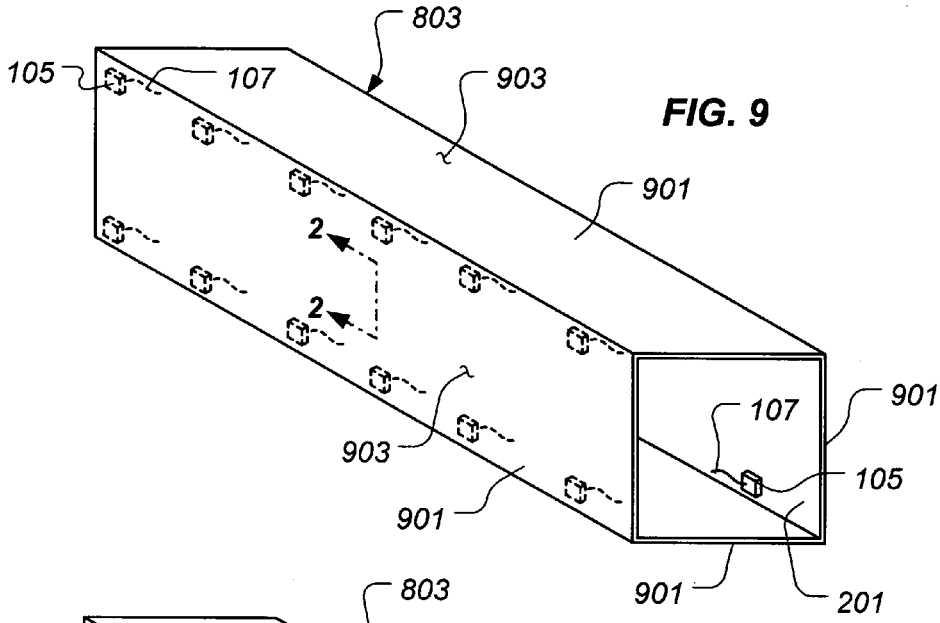
FIG. 9 is a stylized, perspective view of a first illustrative embodiment of a canister according to the present invention.

FIG. 9 depicts a first illustrative embodiment of canister 803 according to the present invention. In this embodiment, reactive panel 103 is incorporated into the structure of canister 803. Substrate 203 comprises a canister wall 901 and reactive layers 201 are disposed on an inside surface 1001 (see FIG. 10) of canister wall 901. In other words, the cross-sectional construction of canister wall 901 corresponds to the cross-sectional construction of reactive panel 103 shown in FIG. 2, such that canister wall 901 comprises substrate 203. Transition manifolds 105 are disposed adjacent or in contact with nth reactive layer 201*n*, within the confines of canister 803. Note that reactive layers 201 may cover the entire inside surface 1001 of canister wall 901 or may only cover portions of the inside surface 1001 of canister wall 901. For example, reactive layers 201 may be disposed on inside surface 1001 of canister wall 901 only in areas proximate energetic materials 805, 807. Moreover, reactive layers 201 may be disposed on an outer surface 903 of canister wall 901.

Figure 10:
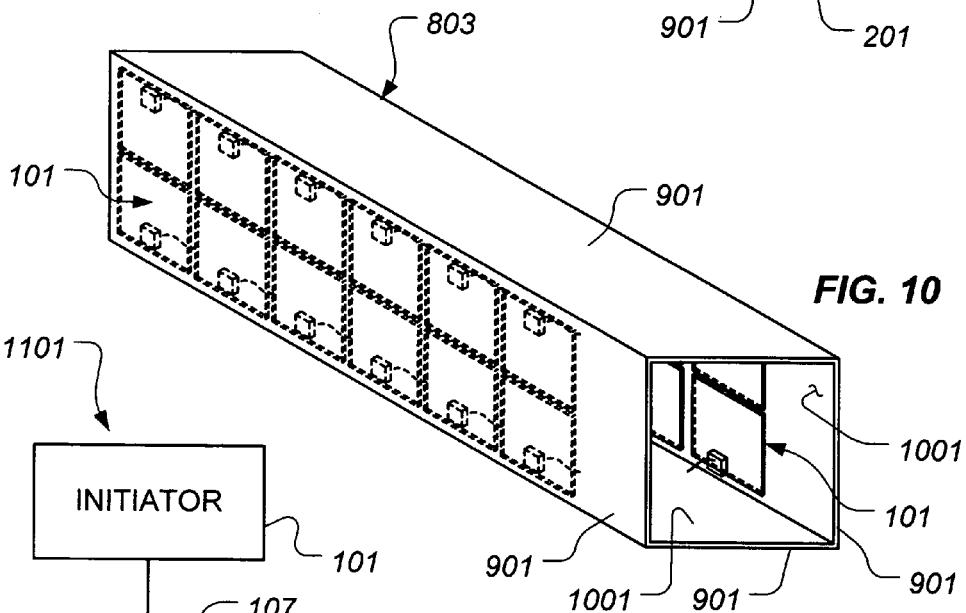
FIG. 10 is a stylized, perspective view of a second illustrative embodiment of a canister according to the present invention.

FIG. 10 depicts a second illustrative embodiment of canister 803, in which initiators 101 are disposed on inside surface 1001 of canister wall 901. Initiators 101 may be attached to inside surface 1001 by any suitable means. Note that the particular pattern of initiators 101 on inside surface 1001 depicted in FIG. 10 is merely exemplary. Depending upon the implementation, initiators 101 may be provided to completely cover inside surface 1001 or only a portion of inside surface 1001. Further, initiators 101 may be disposed on inside surface 1001 only in areas proximate energetic materials 805, 807. Moreover, reactive layers 201 may be disposed on outer surface 903 of canister wall 901. In various embodiments of the present invention, e.g., the embodiments of FIGS. 9 and 10, initiator 101 is operatively associated with canister 803.

Figure 11:
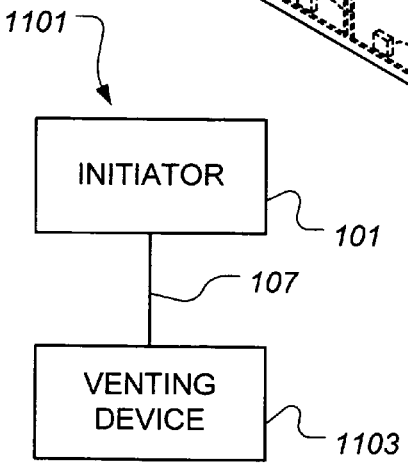
FIG. 11 is a block diagram illustrating one particular embodiment of a venting system according to the present invention.

FIG. 11 depicts an illustrative embodiment of a venting system 1101 according to the present invention. In this embodiment, initiator 101 is energetically coupled with a venting device 1103 via one or more transfer lines 107. When initiator 101 is initiated by an impact or other such initiating event, venting device 1103 is activated via transfer line 107.

Figure 12:
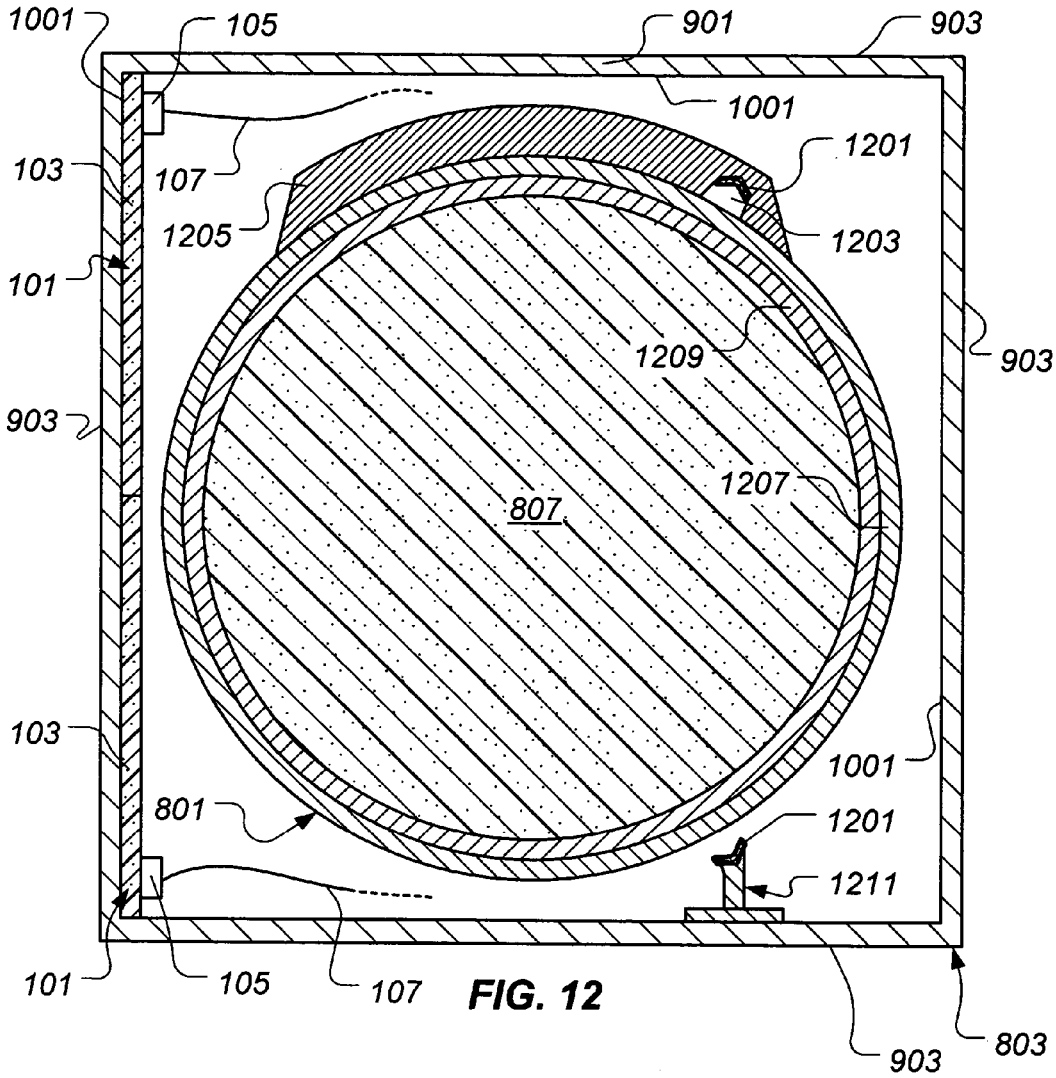
FIG. 12 is a stylized, cross-sectional view of the munition and the canister of FIG. 8 taken along the line 12-12 of FIG. 8.

FIG. 12 depicts, in cross-section, one particular embodiment of the munition 801 and the canister 803 of FIG. 8. While initiators 101 are shown disposed on inside surface 1001 of canister 803 in FIG. 12, initiators 101 may, for example, be disposed on outer surface 903, or incorporated into canister 803, as discussed above concerning FIGS. 9-10. In the illustrated embodiment, a linear shaped charge 1201 is disposed in a cavity 1203 defined by a wireway 1205 of munition 801. Thus, in this embodiment, linear shaped charge 1201, which is a venting device, is operatively associated with munition 801. Munition 801 comprises propellant 807 disposed within a casing 1207. In this particular embodiment, an insulating layer 1209 is disposed between propellant 807 and casing 1207. Note that propellant 807 may comprise any energetic material, such as explosive 805 (shown in FIG. 8).

Linear shaped charge 1201 may, alternatively, be attached to canister 803 instead of or in addition to being disposed in or on munition 801. In this particular embodiment, also shown in FIG. 12, linear shaped charge 1201 is disposed in or on a bracket 1211 extending from inner surface 1001 of canister 803. Linear shaped charge 1201, which is a venting device, is operatively associated with canister 803. In either case, initiators 101 are energetically coupled with one or more linear shaped charges 1201 such that, when initiators 101 are initiated, one or more linear shaped charges 1201 are activated to vent case 1207. Note that linear shaped charge 1201 is but one exemplary means for venting case 1207. Other means for venting case 1207, capable of being activated by initiator 101, are within the scope of the present invention.

Figure 13:
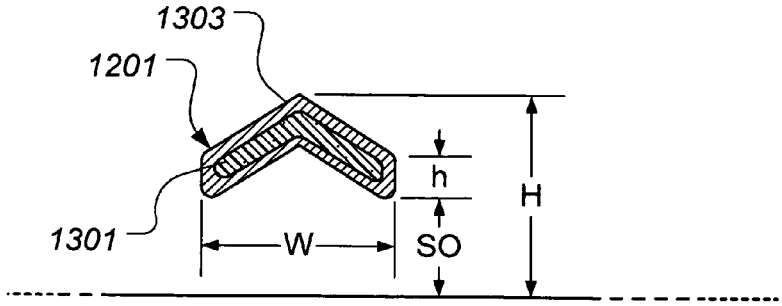
FIG. 13 is a stylized cross-sectional view of an illustrative embodiment of a linear shaped charge according to the present invention.

FIG. 13 depicts one illustrative embodiment of linear shaped charge 1201 according to the present invention. In this embodiment, linear shaped charge 1201 comprises an explosive 1301, such as a PBXN5 explosive, enveloped by a sheath 1303. Sheath 1303 may comprise copper, a copper alloy, or other material suitable for linear shaped charge 1201. As used herein, the term "linear shaped charge" includes linear shaped charges that have straight or curved forms and may be flexible or rigid.

In one particular embodiment, the "coreload" of explosive 1301 is about 15 grains per foot. The "coreload" is the explosive core of linear shaped charge 1201, expressed as the weight in grains of explosive per foot. In other embodiments, however, the coreload may be within a range of about 10 grains per foot to about 50 grains per foot. The scope of the present invention, however, encompasses any suitable coreload, as it is highly dependent upon the particular implementation. Other explosive materials and sheaths, however, may be used and are encompassed by the present invention. Linear shaped charge 1201 is disposed such that, when detonated, the jet formed by detonated charge 1201 may travel substantially unimpeded to case 1207.

Referring in particular to the embodiment of FIG. 12, for a thickness of case 1207 within a range from about 0.14 inches to about 0.23 inches, the overall height H of linear shaped charge 1201 is about 0.16 inches and its width W is about 0.22 inches. In this example, the leg height h of the linear shaped charge 1201 is about 0.06 inches. The standoff SO from linear shaped charge 1201 to case 1207 is about 0.18 inches. The present invention, however, is not limited to this configuration. Rather, the particular dimensions of linear shaped charge 1201 and the standoff between the linear shaped charge 1201 and case 1207 will be determined based upon at least the particular explosive 1301, material of sheath 1303, material of case 1207, and the thickness of case 1207, as will be appreciated by one of ordinary skill in the art having the benefit of this disclosure.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An initiator, comprising:

a reactive panel comprising:

a substrate; and a plurality of reactive layers disposed on the substrate, wherein a reactive layer of the plurality of reactive layers is configured to react when the reactive panel is subjected to an impact; and a transition manifold coupled with the reactive panel;

wherein at least one of the plurality of reactive layers comprises:

a first sublayer comprising a first material; and a second sublayer comprising a second material capable of exothermically reacting with the first material.

2. The initiator according to claim 1, wherein the at least one of the plurality of reactive layers further comprises:

a separation layer disposed between the first sublayer and the second sublayer.

3. The initiator according to claim 1, wherein the at least one of the plurality of reactive layers further comprises:

an intermingled zone disposed between the first layer and the second layer including a product of a reaction between the first material and the second material.

4. The initiator according to claim 1, wherein the material of the first sublayer and the material of the second sublayer, when combined, form a material selected from the group consisting of silicides, aluminides, borides, and carbides.

5. The initiator according to claim 1, wherein the materials of the first sublayer and the second sublayer comprise:

thermite reacting compounds.

6. The initiator according to claim 1, wherein at least one of the first sublayer and the second sublayer comprises:

a metallic glass, a composite material, or a metal ceramic.

7. The initiator according to claim 1, wherein the transition manifold comprises:

a housing; and a booster disposed in the housing, the booster disposed proximate the reactive panel.

8. The initiator, according to claim 1, wherein the initiator is configured to be operably associated with a munition.

9. The initiator, according to claim 1, wherein the initiator is configured to be operably associated with a venting system.

10. An initiator, comprising:

a reactive panel, comprising:

a substrate; and a plurality of reactive layers disposed on the substrate, each of the plurality of reactive layers comprising:

a first sublayer comprising a first material;

a second sublayer comprising a second material capable of exothermically reacting with the first material; and a separation layer disposed between the first sublayer and the second sublayer; and a transition manifold coupled with the reactive panel, wherein the first sublayer reacts with the second sublayer when subjected to an impact sufficient to breach the separation layer.

11. The initiator, according to claim 10, wherein the material of the first sublayer and the material of the second sublayer, when combined, form a material selected from the group consisting of silicides, aluminides, borides, and carbides.

12. The initiator according to claim 10, wherein the materials of the first sublayer and the second sublayer comprise:

thermite reacting compounds.

13. The initiator according to claim 10, wherein at least one of the first sublayer and the second sublayer comprises:

a metallic glass, a composite material, or a metal ceramic.

14. The initiator according to claim 10, wherein the transition manifold comprises:

a housing; and a booster disposed in the housing, the booster disposed proximate the reactive panel.

* * * * *